US008490449B2

(12) United States Patent
Bytow et al.

(10) Patent No.: US 8,490,449 B2
(45) Date of Patent: Jul. 23, 2013

(54) TOOLS, MACHINES AND PROCESSES FOR DEBURRING CUT EDGES ON WORKPIECES

(75) Inventors: Peter Bytow, Simmozheim (DE); Martin Decker, Vaihingen (DE); Martin Steiner, Weil der Stadt (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 0 days.

(21) Appl. No.: 13/238,546

(22) Filed: Sep. 21, 2011

(65) Prior Publication Data

US 2012/0006211 A1 Jan. 12, 2012

Related U.S. Application Data

(60) Division of application No. 11/551,314, filed on Oct. 20, 2006, now Pat. No. 8,042,369, which is a continuation of application No. PCT/EP2005/003730, filed on Apr. 8, 2005.

(30) Foreign Application Priority Data

Apr. 26, 2004 (DE) ..... 10 2004 020 483

(51) Int. Cl.
*B21D 17/04* (2006.01)
*B21D 28/00* (2006.01)
*B21C 37/30* (2006.01)

(52) U.S. Cl.
USPC ..... 72/75; 72/335; 29/90.01

(58) Field of Classification Search
USPC ..... 72/72, 75, 70, 335, 214, 220, 197, 72/196; 29/90.01
See application file for complete search history.

(56) References Cited

U.S. PATENT DOCUMENTS 3,315,511 A 4/1967 Turner
3,478,558 A 11/1969 Hoffman et al.
3,724,251 A 4/1973 Wegner (Continued)

FOREIGN PATENT DOCUMENTS

DE 4113165 10/1991
DE 19848144 4/2000

(Continued)

OTHER PUBLICATIONS

International Preliminary Report on Patentability from Application No. PCT/EP2005/003730, mailed Nov. 29, 2006.

(Continued)

*Primary Examiner* — Dana Ross
*Assistant Examiner* — Mohammad I Yusuf
(74) *Attorney, Agent, or Firm* — Fish & Richardson P.C.

(57) ABSTRACT

A tool for deburring cut edges on workpieces has a pressure body in the form of a rolling body, by means of which, as relative longitudinal movement of rolling body and workpiece takes place, pressure can be applied to the burr on the relevant cut edge in the direction towards the workpiece while the rolling body rolls along the cut edge.

A machine for deburring cut edges on workpieces is provided with a tool of the above-mentioned kind.

In the course of a process for deburring cut edges on workpieces, a rolling body is moved along the relevant cut edge with a rolling motion. In that movement, pressure is applied by means of the rolling body to the burr on the cut edge in the direction towards the workpiece.

5 Claims, 5 Drawing Sheets

U.S. PATENT DOCUMENTS

| | | | | |
|---|---|---|---|---|
| 3,949,586 | A | 4/1976 | Neumann | |
| 4,369,643 | A | 1/1983 | Cianciolo et al. | |
| 5,682,782 | A | 11/1997 | Rosene et al. | |
| 5,761,944 | A | 6/1998 | Endo et al. | |
| 6,868,763 | B2 * | 3/2005 | Graf | 83/49 |
| 7,367,210 | B2 | 5/2008 | Nishibu | |
| 2003/0106404 | A1 | 6/2003 | Graf | |
| 2005/0045014 | A1 | 3/2005 | Graf | |

FOREIGN PATENT DOCUMENTS

| | | |
|---|---|---|
| EP | 0739254 | 10/1996 |
| EP | 0995510 | 4/2000 |
| JP | 3-42320 | 4/1991 |
| JP | 9052129 | 2/1997 |
| JP | 10263721 | 10/1998 |
| JP | 2003-200228 | 7/2003 |

OTHER PUBLICATIONS

Office Action from corresponding Japanese Application No. 2007-508761, mailed Oct. 22, 2008, 5 pages.

* cited by examiner

TOOLS, MACHINES AND PROCESSES FOR DEBURRING CUT EDGES ON WORKPIECES

RELATED APPLICATIONS

This application is a divisional of, and claims priority under 35 U.S.C. §120 to U.S. Ser. No. 11/551,314, filed Oct. 20, 2006, which is a continuation of PCT/EP2005/003730, filed on Apr. 8, 2005, and designating the U.S., and claims priority under 35 U.S.C. §119 from German application DE 10 2004 020 483.7, filed Apr. 26, 2004. All of these priority applications are hereby incorporated by reference in their entirety.

TECHNICAL FIELD

This invention relates to tools, machines and processes for deburring cut edges on workpieces.

BACKGROUND

The prior art, as exemplified by JP 09103828 A, discloses using a press to deburr the cut edges of punched apertures in plate-shaped workpieces. The press comprises a tool with two tool parts, a punch and a die. The punch is assigned to that side of the workpiece on which a burr projects along the cut edge of a previously punched aperture. The cross-section of the punch is oversized in relation to the cross-section of the punched aperture. The die is arranged on the opposite side of the workpiece. To deburr the cut edge at the punched aperture, the punch and the die are moved towards each other in a stroke direction. In that operation, on one side of the workpiece pressure is applied to the edge region of the punched aperture by the punch. On the opposite side, the workpiece being acted upon by the punch is supported by means of the die. Under the effect of the application of pressure by the punch, the previously formed burr on the cut edge of the punched aperture is eliminated.

If the length of the cut edge to be deburred exceeds the corresponding extent of the punch, the punch and the die have to execute a plurality of strokes between each of which the workpiece has to be moved in the direction of the cut edge to be deburred. The step width of this movement must not exceed the relevant extent of the punch.

SUMMARY

The present disclosure relates to tools for deburring cut edges on workpieces. The tools disclosed herein have a pressure body, the pressure body and the workpiece being longitudinally movable relative to each other along at least one cut edge to be deburred on the workpiece. The pressure body is configured to apply pressure to a burr on the cut edge in the direction towards the workpiece. The present disclosure further relates to machines for deburring cut edges on workpieces and processes for deburring cut edges on workpieces using the tools disclosed herein.

In one aspect, the disclosure features a tool for deburring cut edges on workpieces. The tool includes a pressure body, in the form of a rolling body, the rolling body and a workpiece being longitudinally movable relative to each other along at least one cut edge to be deburred on the workpiece. The rolling body is configured to roll along the cut edge and apply pressure to a burr on the cut edge, in a direction towards the workpiece, as the relative longitudinal movement of the rolling body and the workpiece takes place.

Advantageously, the rolling body allows continuous elimination of the burr formed on the cut edge. In preferred implementations, continuous deburring is possible in the case of a relatively great length of the cut edges and in the case of cut edges extending other than in a straight line. In the latter case, it is merely necessary to control the relative longitudinal movement of rolling body and workpiece accordingly, as will be discussed below. The tools, machines and processes disclosed herein may be applied irrespective of the process by which the cut edge to be deburred has been made. For example, a punching burr may be eliminated according to the invention just as efficiently as a burr on a thermally cut workpiece edge. In each case, it is possible for deburring to take place with great speed yet with little noise. Under the effect of the application of pressure by the rolling body, the burr can be compressed in the region of the relevant cut edge and thereby removed. Alternatively, the burr can be severed from the workpiece by the application of pressure by the rolling body.

In some implementations, the rolling body may be in the form of a pressure roller and, for relative longitudinal movement of rolling body and workpiece, the pressure roller may be supported by means of a pivot bearing arrangement so as to be rotatable about a feed-rotation axis extending transversely to the direction of the relative longitudinal movement of rolling body and workpiece. Alternatively, the rolling body may be in the form of a pressure ball, which may be supported so as to be universally rotatable. The orientation of the rotation axis of these rolling body constructions can be selected to suit a particular purpose. If the rotation axis of the rolling body extends transversely to the workpiece, the rolling body, especially when in lateral contact with the cut face of the workpiece forming the relevant cut edge, is able to follow any desired course of the cut edge to be machined, including courses not extending in a straight line. A pressure ball supported so as to be universally rotatable is distinguished by having a corresponding flexibility in relation to the course of the cut edge.

The feed-rotation axis of the rolling body may extend transversely to the direction of the relative longitudinal movement of the rolling body and the workpiece and transversely to a cut face of the workpiece forming a cut edge, and the rolling body may be rotatable together with its pivot bearing arrangement about an orientation-rotation axis extending transversely to the direction of the relative longitudinal movement of rolling body and workpiece and transversely to the feed-rotation axis of the rolling body. If the rotation axis of the rolling body is oriented parallel to the workpiece, a comparatively small overall height of the tool part provided with the rolling body is advantageously produced. Moreover, such rolling bodies exhibit an enhanced ability to follow curves. Rotatability of the rolling body about an orientation-rotation axis enables the rolling body to follow cut edges that do not extend in a straight line. A controlled drive may be provided for executing the rotational movements of the rolling body about the orientation-rotation axis. Alternatively, the rolling body may freely rotate about the orientation-rotation axis, accompanied by self-orientation of the rolling body.

In some implementations, the rolling body and the workpiece are longitudinally movable relative to each other along two mutually opposing spaced cut edges of the workpiece that are to be deburred, and the rolling body is configured to apply pressure to the burr on both cut edges in the direction towards the workpiece while the rolling body rolls along the cut edges, e.g., to apply pressure to both edges substantially simultaneously. Accordingly, it is advantageously possible for two cut edges to be deburred in one pass using one rolling body.

The tool may be configured to permit, in addition to deburring, also a shaping, especially chamfering, of the cut edges. Owing to the rolling action on the cut edge, shaping of the cut edge without any shouldering is obtained.

The rolling body has a pressure surface, via which pressure can be applied by the rolling body to the burr on at least one cut edge, the pressure surface being configured to contact both faces of the workpiece forming the cut edge during deburring. Owing to this configuration of the pressure surface on the rolling body, optimum elimination of the burr formed on the cut edge is ensured. In particular, the burr on the cut edge may be effectively compressed. When the rolling body is supported freely about an orientation-rotation axis, that part of the pressure surface on the rolling body which is opposite the face of the workpiece forming the relevant cut edge may also serve to control the orientation of the rolling body about the orientation-rotation axis. Finally, the form of the chamfer on the cut edge may, where appropriate, be defined by way of the geometry of the rolling body pressure surface.

In the interests of an optimum functional capability, for example in the case of small workpiece thicknesses, the tool may have on that side of the workpiece being machined which is remote from the portion of the tool supporting the rolling body, a counter-bearing which supports the workpiece to which pressure is being applied by the rolling body.

In another aspect, the disclosure features a machine for deburring cut edges on workpieces, the machine comprising: (a) a machine base unit, and, mounted on the base unit, (b) a tool comprising a pressure body in the form of a rolling body, the rolling body and a workpiece being longitudinally movable relative to each other along at least one cut edge to be deburred on the workpiece, and the rolling body being configured to roll along the cut edge and apply pressure to a burr on the cut edge, in a direction towards the workpiece, as the relative longitudinal movement of the rolling body and the workpiece takes place.

In some implementations, the machine further includes a tool holder arrangement, mounted on the machine base unit, configured to receive the tool. The tool holder arrangement may comprise a pair of tool holders disposed on opposite sides of the workpiece to receive first and second portions of the tool, the tool holders being movable relative to each other in a transverse direction of the workpiece. The machine may also include a workpiece feed, the workpiece feed being configured to provide relative longitudinal movement between, the workpiece and the tool holders transversely to the direction of the relative movability of the tool holders.

In some implementations, the tool holders are configured to removably receive the first and second portions of the tool. For example, at least one punch and at least one punching die of a punching tool, and at least one rolling body and at least one counter-bearing of a tool for deburring can be inserted, as replacements for one another, into the tool holders. The workpiece feed may be configured to move the workpiece and the punching tool longitudinally relative to each other during punching, and to move the workpiece and the tool for deburring longitudinally relative to each other during deburring.

The machines disclosed herein may be used, in addition, for punching machining of workpieces. The production of cut edges and the deburring thereof may accordingly be carried out on the same machine. The cutting/punching and deburring tools can also be replaced by other types of tools if desired, thereby expanding the functions of the machine.

In another aspect, the disclosure features a process for deburring cut edges on workpieces comprising: (a) contacting a pressure surface of a pressure body in the form of a rolling body with a cut edge on a workpiece, (b) moving the pressure body and a workpiece longitudinally relative to each other so that the rolling body rolls along the cut edge, and (c) applying pressure, via the pressure surface, to a burr on the cut edge in the direction towards the workpiece while the rolling body rolls along the cut edge.

The details of one or more implementations are set forth in the accompanying drawings and the description below. Other features and advantages of the disclosed tools and machines will be apparent from the description and drawings, and from the claims.

DETAILED DESCRIPTION

Figure 1:
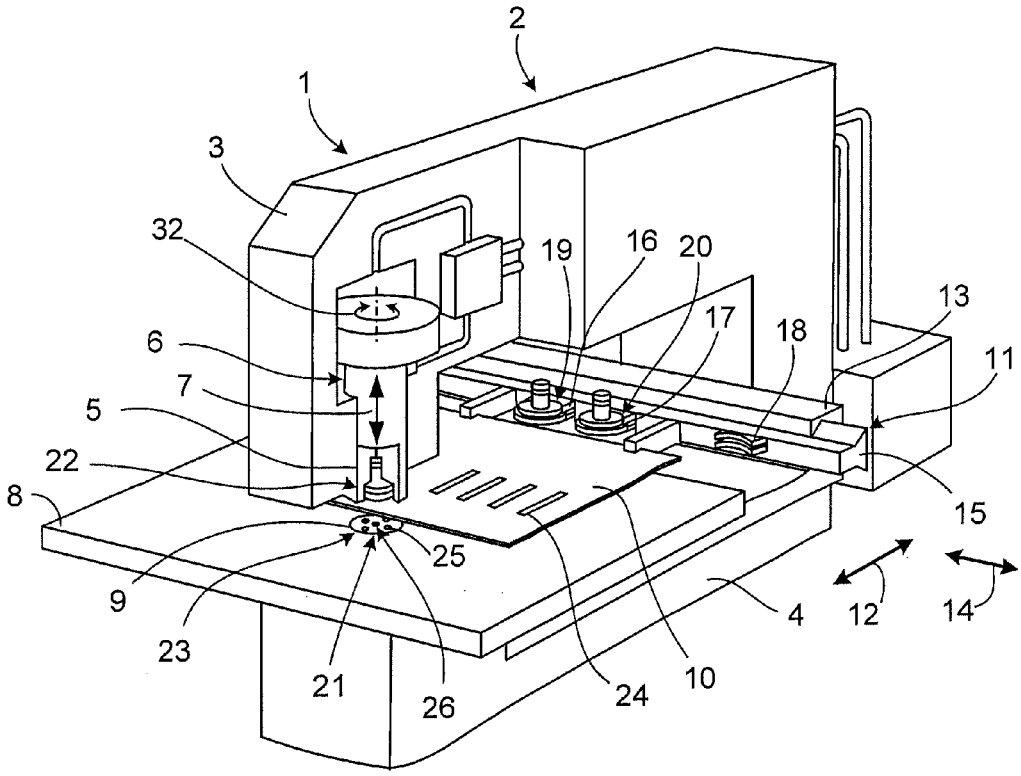
FIG. 1 shows a machine for punching machining of metal sheets and for deburring the cut edges produced during punching machining.

As shown in FIG. 1, a machine 1 has a C-shaped machine frame 2 comprising an upper frame limb 3, shown partially in section, and a lower frame limb 4. On the upper frame limb 3, a ram 6 provided with an upper tool holder 5 is guided to be movable in the direction of an axis 7 illustrated by a double-headed arrow. The lower frame limb 4 is provided with a workpiece table 8 in which a lower tool holder 9 is integrated. The upper tool holder 5 and the lower tool holder 9 are rotationally adjustable (double-head arrow 32) about the axis 7 by means of a suitable rotary drive. The rotary drive of the upper tool holder 5 and the lower tool holder 9 is numerically controlled, as are the other functional devices of the machine 1.

The workpiece table 8 supports in known manner a workpiece in the form of a metal sheet 10. The latter is movable by means of a workpiece feed, in this case a conventional coordinate guide system 11, in a horizontal plane over the workpiece table 8. For that purpose, the coordinate guide system 11 has a transverse guide 13 which is displaceable in the direction of a double-headed arrow 12, and a transverse rail 15 which is movable on the transverse guide 13 in the direction of a double-headed arrow 14. The transverse rail 15 of the coordinate guide system 11 serves at the same time as a tool magazine. In that capacity, the transverse rail 15 is provided with tool racks 16, 17, 18.

In the example illustrated, the tool racks 16, 17 receive punching tools 19, 20 which may be of customary construction. The tool rack 18 is provided for a tool 21 which includes an upper tool part 22 and a lower tool part 23. In the illustrated deburring phase of the machining of metal sheet 10, tool 21 has been removably inserted into the machine frame 2, with the upper tool part 22 being positioned in the upper tool holder 5 and the lower tool part 23 being positioned in the lower tool holder 9. Because the tool parts are removably mounted, they can be replaced by the punching tools and, if desired by other tools (not shown).

The tool 21 serves to deburr cut edges 24 on the underside of the metal sheet 10. The cut edges 24 have been made previously by punching machining of the metal sheet 10, e.g., by means of the punching tools 19, 20. For example, in one implementation, in an initial punching operation, instead of the tool 21, the punching tools 19, 20 were successively inserted into machine frame 2, with their punches being positioned in the upper tool holder 5 and their punching dies being positioned in the lower tool holder 9. A total of four slots having cut edges 24 adjoining one another in a rectangular shape on the underside of the metal sheet were punched free in the metal sheet 10. In the process, a burr was formed on all the cut edges 24.

In the operating state shown in FIG. 1, the ram 6 on the upper frame limb 3 of the machine frame 2 has been raised with the upper tool holder 5 and with the upper tool part 22 of the tool 21 fixed therein. At the lower tool part 23 of the tool 21, workpiece supports 25 lie flush at their upper side with the free axial end of a pin-like rolling body 26 constructed as a pressure roller. The metal sheet 10 is in the position shown in FIG. 1.

Figure 2:
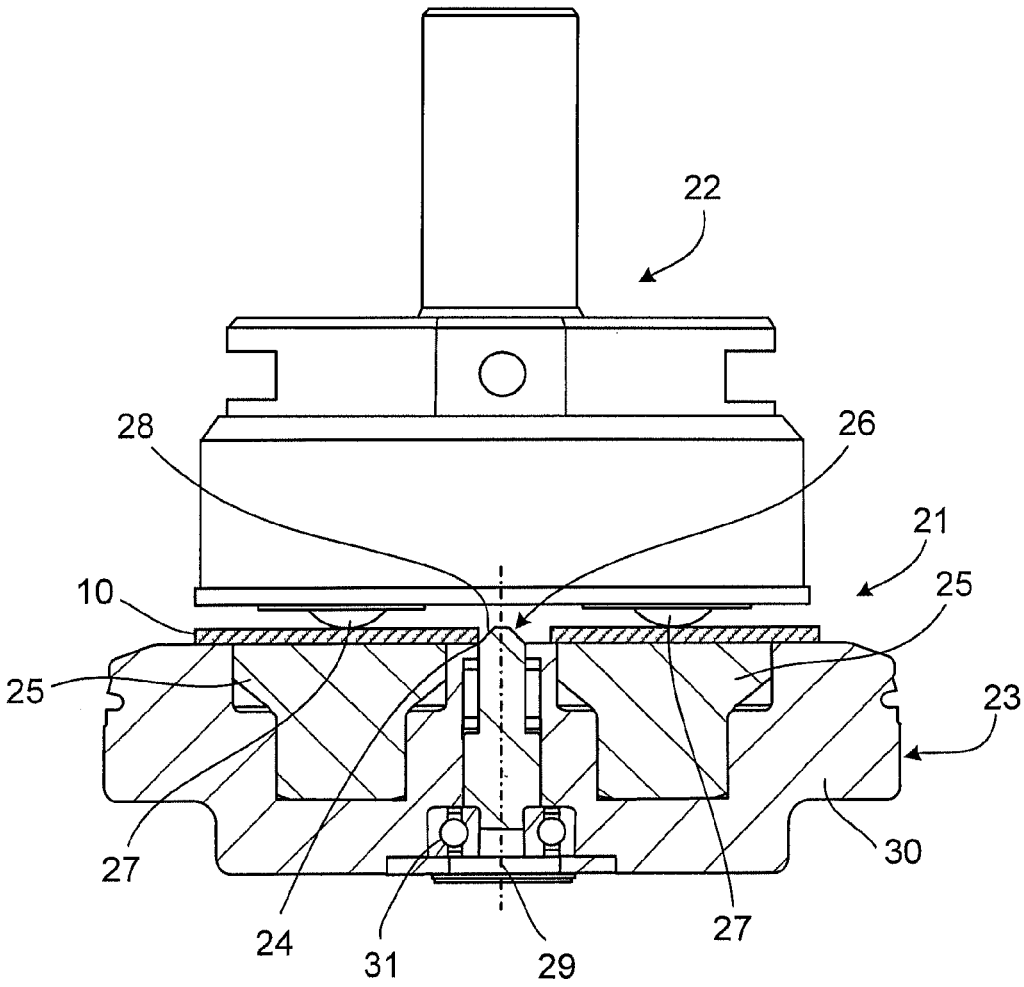
FIGS. 2 to 4 show tools for deburring cut edges that can be used on the machine shown in FIG. 1.

Starting from that situation, first the metal sheet 10 is positioned relative to the tool 21 by means of the coordinate guide system 11 in such a manner that one of the cut edges 24 of the slot disposed towards the edge of the metal sheet 10 comes to lie above the rolling body 26 of the tool 21. Then, the ram 6 is lowered with the upper tool part 22 of the tool 21. In that movement, the upper tool part 22 runs with its underside, more specifically with universally rotatable counter-pressure balls 27 shown in FIG. 2 which serve as counter-bearings, onto the upper side of the metal sheet 10 resting on the workpiece supports 25 of the lower tool part 23. As the lowering movement of the ram 6 continues, the metal sheet 10 is pressed downward while the workpiece supports 25 undergo resilient deformation. The cut edge 24 on the metal sheet 10, which cut edge is initially disposed above the rolling body 26, consequently comes to rest on a conical pressure surface 28 (FIG. 2) of the rolling body 26. Pressure is then applied to the cut edge by the rolling body 26 via the pressure surface 28. The pressure surface 28 extends along both faces of the metal sheet 10 forming the cut edge 24. Accordingly, it lies opposite both the underside of the metal sheet 10 and the cut face of the metal sheet 10 adjoining the underside. Altogether, the situation shown in FIG. 2 is produced.

The metal sheet 10, to which pressure is being applied by the tool 21, is now moved relative to the tool 21, in the plane indicated by arrows 12 and 14, by means of the coordinate guide system 11. As the sheet moves, the pressure surface 28 of the rolling body 26 rolls along the entire length of the cut edges 24 of the relevant slot in the metal sheet 10. During that movement, the rolling body 26 rotates about a perpendicular feed-rotation axis 29. The pin-like rolling body 26 is rotatably supported on a base body 30 of the lower tool part 23 via a pivot bearing arrangement 31. By means of the pin-like rolling body 26 it is also possible to deburr, in particular, cut edges with tight radii. There is no need for a rotational adjustment of the rolling body 26 in the direction of the double-headed arrow 32 (see FIG. 3) when the direction of the cut edge being machined changes.

Under the effect of the application of pressure by the rolling body 26 the burr projecting at the cut edges 24 is eliminated by compression. At the same time, the cut edges 24 are slightly chamfered by means of the rolling body 26. The shape of the chamfer formed is determined by the geometry of the pressure surface 28 on the rolling body 26. The chamfer shape could moreover be influenced by varying the orientation of the feed-rotation axis 29 of the rolling body 26.

Once the rolling body 26 has traveled over all the cut edges 24 of a slot, the ram 6 is raised until the metal sheet 10 becomes free. In that operation, the workpiece supports 25 are relieved of pressure and are in their starting state in which they are flush at their upper side with the free axial end of the rolling body 26. The rolling body 26 is again completely below the metal sheet 10. The metal sheet can then be moved in the plane indicated by arrows 12 and 14, and positioned with the cut edges 24 of the next slot adjacent to the tool 21 in the manner described above. When the upper tool part 22 has been lowered again, the cut edges 24 which are now acted upon by the rolling body 26 are deburred and chamfered.

Once the cut edges 24 on all the slots of the metal sheet 10 have been machined, the ram 6 is raised together with the upper tool part 22 to the position shown in FIG. 1.

By means of the coordinate guide system 11, the machined metal sheet 10 is now moved away from the tool 21 and transferred to an unloading position. From that unloading position the metal sheet 10 is finally removed from the machine 1.

Figure 3:
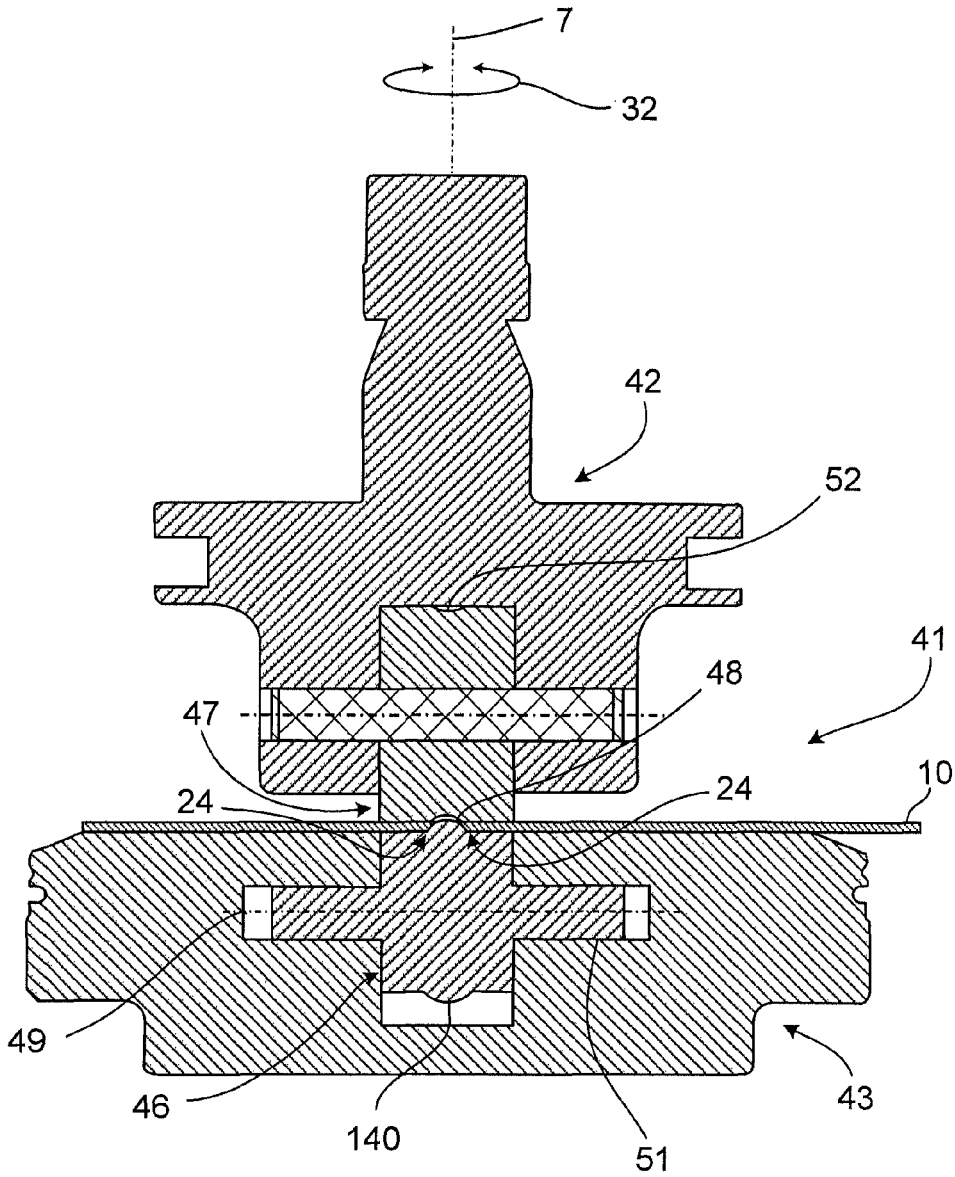

FIG. 3 shows a tool 41 that comprises an upper tool part 42 and a lower tool part 43 and which may be used in place of the tool 21. Unlike the tool 21, in the case of the tool 41 a rolling body 46 in the form of a pressure roller is supported on the lower tool part 43 so as to be rotatable about a horizontal feed-rotation axis 49. A pressure surface 48 is formed by a bead-like radial enlargement 140 which extends circumferentially around the rolling body 46. The geometry of the pressure surface 48 is matched to the spacing between mutually opposing cut edges 24 of the metal sheet 10 and is so selected that pressure may be applied to both cut edges 24 simultaneously. In this case, the pressure surface 48 encompasses both cut edges 24. As a departure from the situation shown, it would also be possible, for example with a suitable spacing between the cut edges, for only a single cut edge to be machined by means of the rolling body 46 and be encompassed by the pressure surface 48 in that process.

At the upper tool part 42 of the tool 41, a counter-pressure roller 47 is supported so as to be rotatable, as a counter-bearing, about an axis extending parallel to the feed-rotation axis 49 of the rolling body 46. At its circumferential surface, the counter-pressure roller 47 is provided with an encircling groove 52 the cross-sectional shape of which corresponds to the cross-sectional shape of the radial enlargement 140 forming the pressure surface 48 on the rolling body 46. In its mode of operation, the tool 41 corresponds in principle to the tool 21. In particular, it is also possible for cut edges not extending in a straight line to be machined with the tool 41. For that purpose, the tool 41 is rotationally adjustable in the direction of the double-headed arrow 32 about the axis 7 of the relative stroke movement of upper tool part 42 and lower tool part 43, said axis 7 defining an orientation-rotation axis for the tool 41. The rotational adjustment is carried out, if necessary, by means of the numerically controlled rotary drive provided for the upper tool holder 5 and the lower tool holder 9 of the machine 1. Alternatively, the tool 41 may rotate freely about the axis 7.

Figure 4:
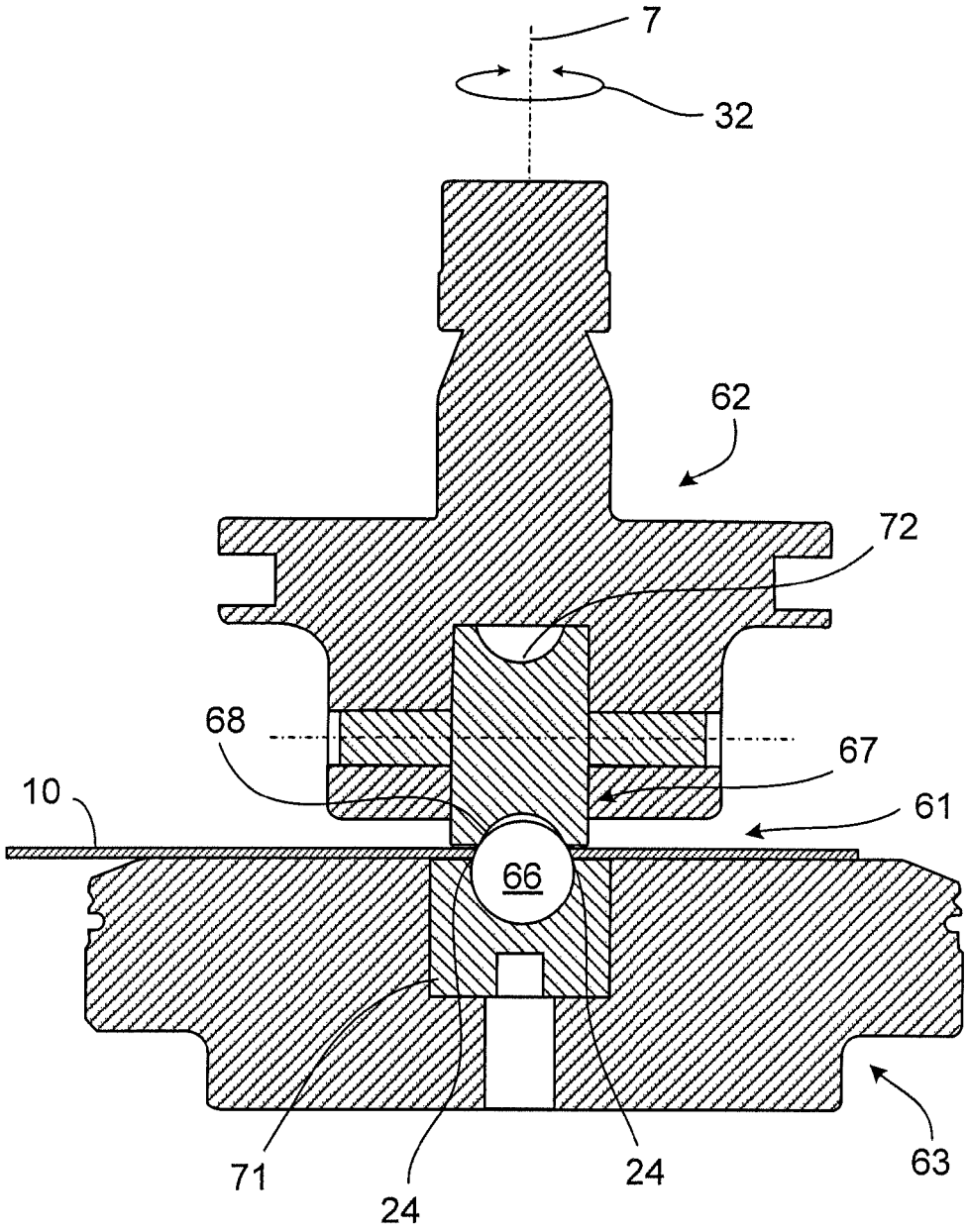

Cut edges defining an opening or the contour of a metal sheet having almost any shape may be deburred with a tool 61 shown in FIG. 4. The tool 61 has an upper tool part 62 and a lower tool part 63. On the latter, a rolling body 66 in the form of a pressure ball is rotatably supported by means of a pivot bearing arrangement 71. The pivot bearing arrangement 71 allows the rolling body 66 to rotate in all directions.

The radius of the rolling body 66 is matched to the spacing of the cut edges 24 on the metal sheet 10. Consequently, two mutually opposing cut edges 24 may be deburred and chamfered at the same time by means of a pressure surface 68 of the rolling body 66. A counter-pressure roller 67, which is supported on the upper tool part 62 of the tool 61 so as to be rotatable about a horizontal rotation axis, serves as the counter-bearing for the metal sheet 10. An encircling groove 72 in the counter-pressure roller 67 has a cross-sectional shape corresponding to the geometry of the pressure surface 68 on the rolling body 66. Like the tool 21, the tool 61 is in principle also rotationally adjustable about the axis 7 in the direction of the double-headed arrow 32. Owing to the ability of the rolling body 66 to rotate in all directions, rotational adjustment of the tool 61 in the case of cut edges not extending in a straight line, if used at all, is generally used only for the upper tool part 62.

The tools 21, 41, 61 can all be inserted interchangeably into the upper tool holder 5 and lower tool holder 9 of the machine 1. Different types of tools may be stored on the transverse rail 15 of the coordinate guide system 11 at the same time. Apart from use for deburring and shaping cut edges as described above, use of the tools 21, 41, 61 for workpiece forming, for example for producing corrugations on the metal sheet 10, is also possible. Conversely, tools that have hitherto been used as forming tools and that make use of corresponding rolling bodies, especially forming rollers and/or balls, may in some cases be used as tools for deburring.

Figure 5:
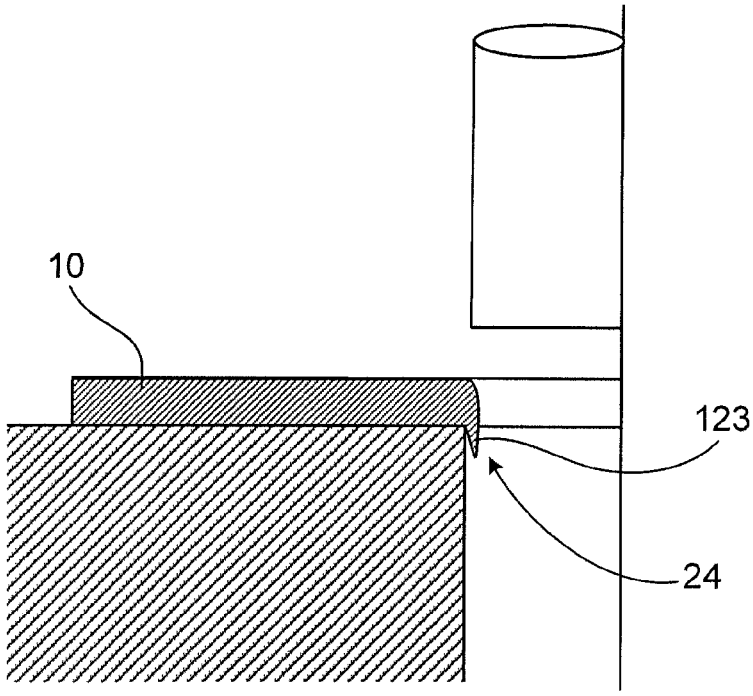
FIGS. 5 and 5A show a cut edge before and after deburring, respectively.
Figure 5A:
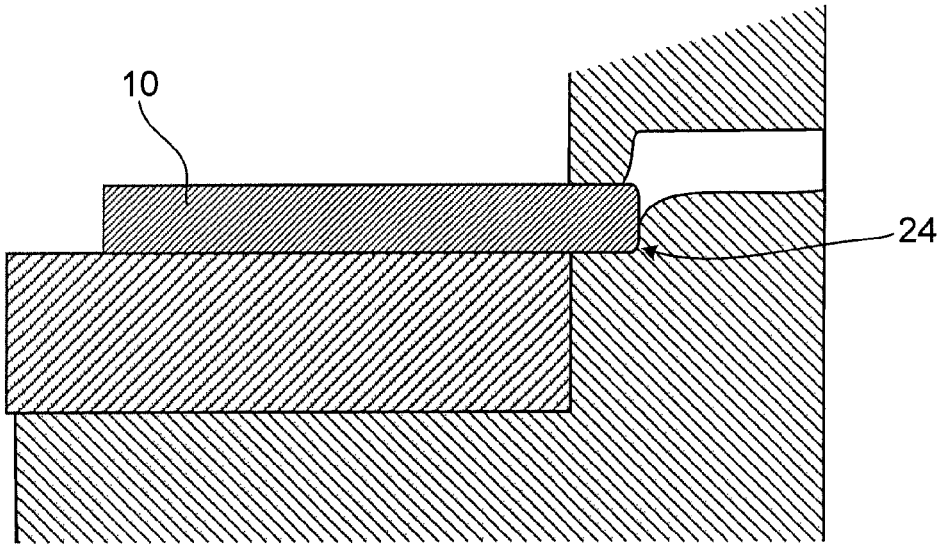

FIG. 5 shows the formation of a burr 123 at the cut edge 24 of the metal sheet 10. A punch and a punching die of the kind used in the case of the punching tools 19, 20 are indicated in outlines. FIG. 5A shows the situation at the cut edge 24 of the metal sheet 10 after deburring and slight chamfering.

A number of implementations have been described. Nevertheless, it will be understood that various modifications may be made without departing from the spirit and scope of the invention. Accordingly, other embodiments are within the scope of the following claims.

What is claimed is:

1. A process for deburring cut edges of workpieces, the process comprising:

contacting a pressure surface of a rolling body to a cut edge of a workpiece, wherein the rolling body comprises a pressure ball supported so as to be universally rotatable, rolling the rolling body along the cut edge of the workpiece, applying pressure, via the pressure surface, to a burr on the cut edge in a direction towards the workpiece while the rolling body rolls along the cut edge, and supporting the workpiece, while pressure is being applied via the pressure surface, at an encircling groove provided on a circumferential surface of a counter-pressure roller that forms a counter-bearing disposed adjacent a side of the workpiece opposite a side on which the rolling body is arranged, wherein the encircling groove has a cross-sectional shape that corresponds to a shape of the pressure surface of the rolling body.

2. A process according to claim 1, wherein the contacting step comprises contacting the pressure surface with two mutually opposing spaced cut edges of the workpiece that are to be deburred, and the rolling body is configured to apply pressure to the burr on both cut edges in the a direction towards the workpiece while the rolling body rolls along the cut edges.

3. A process according to claim 1, further comprising configuring the rolling body to shape the cut edge during deburring.

4. A process according to claim 1 wherein the rolling body is part of a conventional forming tool that comprises corresponding rolling bodies.

5. A process according to claim 3, wherein the rolling body is configured to chamfer the cut edge.

* * * * *

UNITED STATES PATENT AND TRADEMARK OFFICE

CERTIFICATE OF CORRECTION

PATENT NO. : 8,490,449 B2
APPLICATION NO. : 13/238546
DATED : July 23, 2013
INVENTOR(S) : Bytow et al.

It is certified that error appears in the above-identified patent and that said Letters Patent is hereby corrected as shown below:

In the Claims

Column 8, line 18 Claim 2, delete "the a" and insert --a--.

Signed and Sealed this
Third Day of June, 2014

Michelle K. Lee

Michelle K. Lee
*Deputy Director of the United States Patent and Trademark Office*